US008113091B2

(12) United States Patent
Chen

(10) Patent No.: US 8,113,091 B2
(45) Date of Patent: Feb. 14, 2012

(54) HAMMER WITH A SOCKET HOLE BLOCKING DEVICE

(76) Inventor: Yung-Shou Chen, Taichung Hsien (TW)

( * ) Notice: Subject to any disclaimer, the term of this patent is extended or adjusted under 35 U.S.C. 154(b) by 340 days.

(21) Appl. No.: 12/488,583

(22) Filed: Jun. 21, 2009

(65) Prior Publication Data

US 2010/0319496 A1 Dec. 23, 2010

(51) Int. Cl.
*B25D 1/00* (2006.01)

(52) U.S. Cl. ..... 81/20; 81/24

(58) Field of Classification Search ..... 81/20, 23, 81/24, 489; 76/103; 30/308.1; 403/251, 403/248, 409.1
See application file for complete search history.

(56) References Cited

U.S. PATENT DOCUMENTS 4,208,148 A * 6/1980 Biszantz ..... 403/251
4,505,313 A * 3/1985 Finn ..... 81/20
5,758,552 A * 6/1998 Myers et al. ..... 81/20
5,802,933 A * 9/1998 Hebert et al. ..... 81/20

* cited by examiner

*Primary Examiner* — Debra S Meislin
(74) *Attorney, Agent, or Firm* — Pai Patent & Trademark Law Firm; Chao-Chang David Pai

(57) ABSTRACT

A hammer includes a metal hammerhead having a socket hole, a wooden handle fastened to the socket hole, and a socket hole blocking device blocking the socket hole. The socket hole blocking device includes a cap, which is fitted into the socket hole in flush with the metal hammerhead and has wedge holes and a magnet embedded therein for securing an iron nail temporarily for driving into a workpiece, and metal wedge bolts respectively fitted into the wedge holes and driven into the wooden handle.

8 Claims, 7 Drawing Sheets

HAMMER WITH A SOCKET HOLE BLOCKING DEVICE

BACKGROUND OF THE INVENTION (a) Field of the Invention

The present invention relates to hammers and more particularly to a socket hole blocking device for blocking the socket hole of a hammerhead in a flush manner that has an embedded magnet for securing an iron nail temporarily for driving into a wooden workpiece.

(b) Description of the Prior Art

A wooden handle type hammer comprises a metal hammerhead having an open socket, a wooden handle inserted into the open socket of the metal hammerhead, and a wooden wedge block fitted into the open socket to tighten the connection between the metal hammerhead and the wooden handle. After the metal hammerhead and the wooden handle is connected, the mounting end of the wooden handle is not kept in flush with the metal hammerhead. Accordingly, an extra finishing step is necessary to keep the mounting end of the wooden handle in flush with the metal hammerhead. This secondary processing process includes a cutting procedure and a polishing procedure. The extra finishing step is complicated and requires much time and labor.

Further, a metal hammerhead may provide a nail hole having a magnet embedded therein for securing a nail temporarily for driving into a workpiece. However, during the assembly process of this kind of hammer to affix the wooden handle to the metal hammerhead, the aforesaid extra finishing step is necessary. Further, when fastening the wooden handle to the metal hammerhead, the nail hole may be deformed. When this problem occurs, a correction step is necessary to correct the deformed nail hole to the designed dimension. Therefore, this design of hammer would result in a low yield rate and a high manufacturing cost.

SUMMARY OF THE INVENTION

The present invention has been accomplished under the circumstances in view. It is one object of the present invention to provide a socket hole blocking device for hammer, which blocks the socket hole of the hammerhead after the wooden handle is installed, enhancing the connection stability of the wooden handle and keeping the hammerhead clean so that no extra finishing step is necessary.

It is another object of the present invention to provide a socket hole blocking device, which has nail grooves and an embedded magnet for securing an iron nail by means of magnetic attraction.

It is still another object of the present invention to provide a socket hole blocking device, which comprises a cap fitted into the socket hole of the metal hammerhead in a flush manner, and wedge bolts fitted into respective wedge holes on the cap and driven into the wooden handle. The cap is molded from plastics for the advantages of low cost and easy fabrication. Thus, the plastic cap can be fitted into the socket hole of the metal hammerhead easily. Further, the installation of the wedge bolts does not cause the socket hole to deform.

DETAILED DESCRIPTION OF THE PREFERRED EMBODIMENTS

Figure 1:
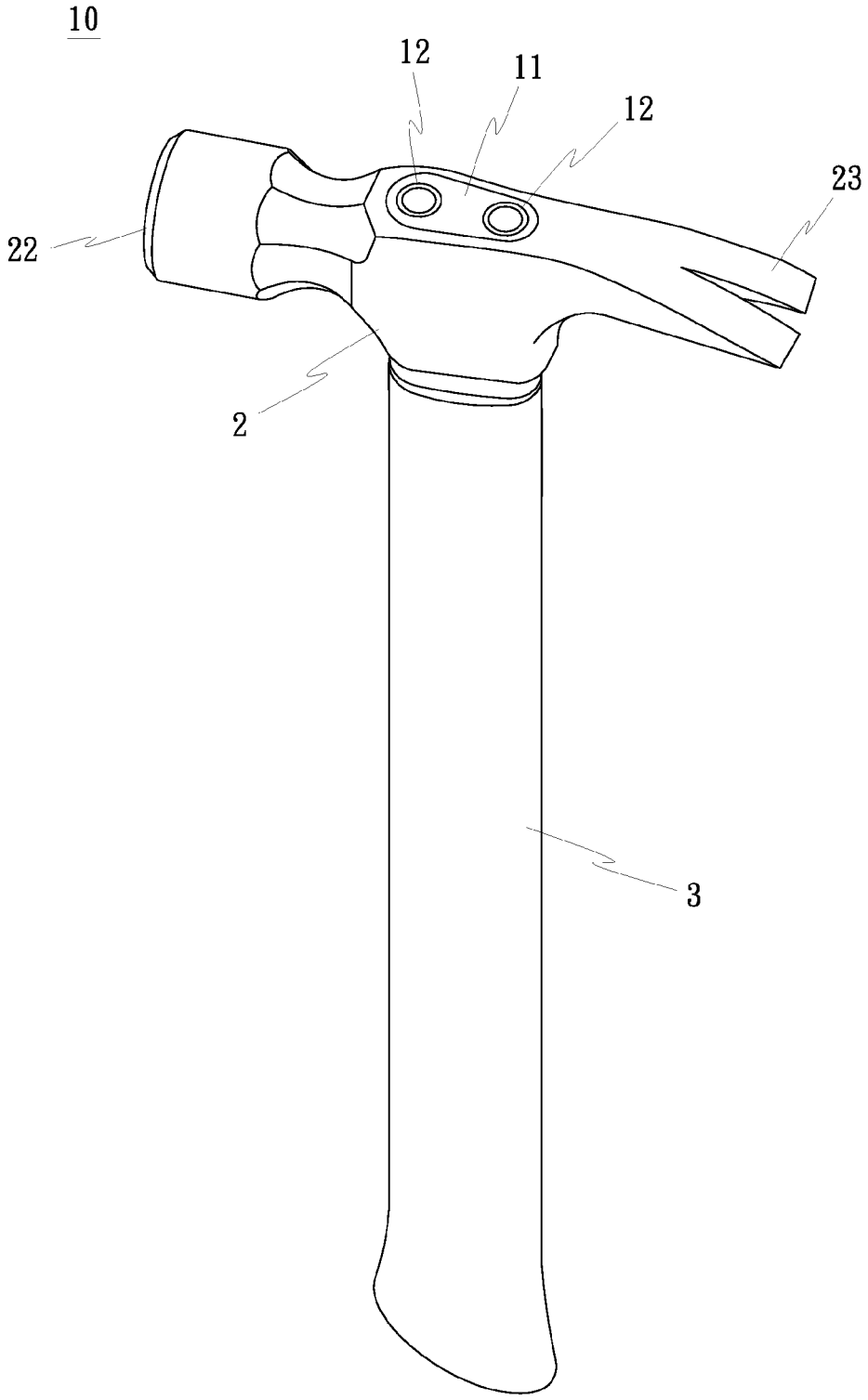
FIG. 1 is an elevational view of a hammer in accordance with a first embodiment of the present invention.
Figure 2:
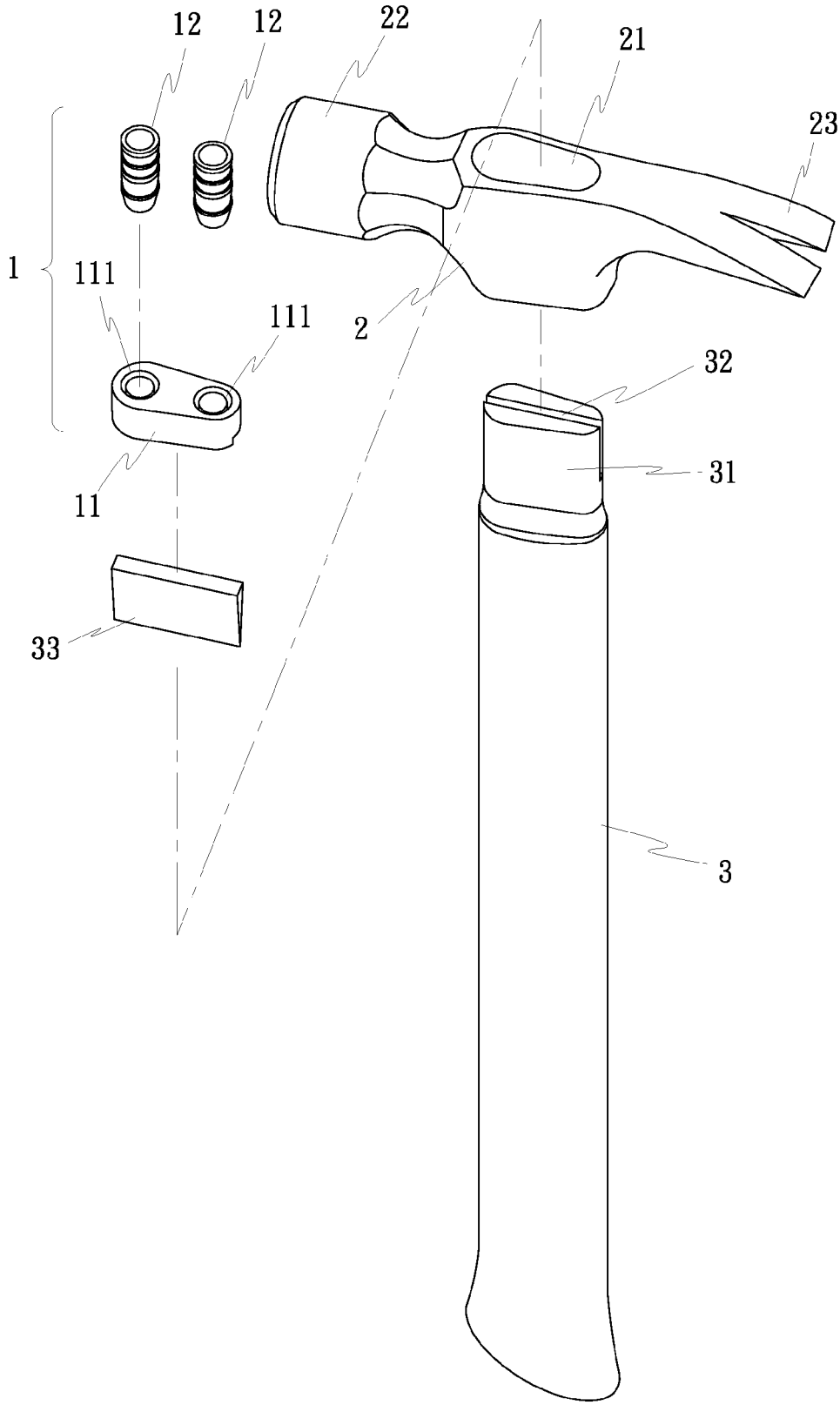
FIG. 2 is an exploded view of the hammer in accordance with the first embodiment of the present invention.

As illustrated in FIGS. 1 and 2, a hammer 10 comprises a socket hole blocking device 1, a hammerhead 2 and a wooden handle 3.

The hammerhead 2 has a socket hole 21 cut through the top and bottom sides of the middle body thereof, a bell 22 at one end, and a claw 23 at the other end.

The socket hole blocking device 1 comprises a cap 11, and at least one, for example two, metal wedge bolts 12. The shape of the cap 11 fits the configuration of the socket hole 21 of the hammerhead 2 so that the cap 11 can be fitted into the socket hole 21. The cap 11 has, for example, two wedge holes 111 for receiving the metal wedge bolts 12, respectively. According to this embodiment, the wedge holes 111 are round holes. The metal wedge bolts 12 are hollow cylindrical wedge bolts having serrated portions extending around the periphery at different elevations. When the metal wedge bolts 12 are respectively forced into the wedge holes 111, they are firmly secured to the cap 11. Further, the length of the metal wedge bolts 12 is greater than the height of the cap 11. When the metal wedge bolts 12 are respectively forced into the wedge holes 111, the bottom ends of the metal wedge bolts 12 are driven into the top mounting endpiece 31 of the wooden handle 3 (see FIG. 3).

The wooden handle 3 is fastened to the socket hole 21 of the hammer head 2, forming the hammer 10. The wooden handle 3 has a crevice 32 located on the top mounting endpiece 31. The length of the top mounting endpiece 31 is shorter than the depth of the socket hole 21. After the top mounting endpiece 3 is inserted into the socket hole 21, a wooden wedge 33 is fitted into the crevice 32 to force the top mounting endpiece 31 against the peripheral wall of the socket hole 21 (see FIG. 3). At this point, a gap is left in the socket hole 21 for receiving the cap 11. After the cap 11 is inserted into the socket hole 21 by force, the metal wedge bolts 12 are respectively inserted into the wedge holes 111 and driven into the top mounting endpiece 31 of the wooden handle 3 and the wooden wedge 33, thus securing the cap 11 firmly in place. At this point, the cap 11 and the wedge bolts 12 are kept in flush with the metal hammerhead 2. Thus, no further secondary finishing step is necessary. Therefore, the invention simplifies the hammer assembly process, improves the hammer manufacturing efficiency, and lowers the hammer manufacturing cost.

Figure 4:
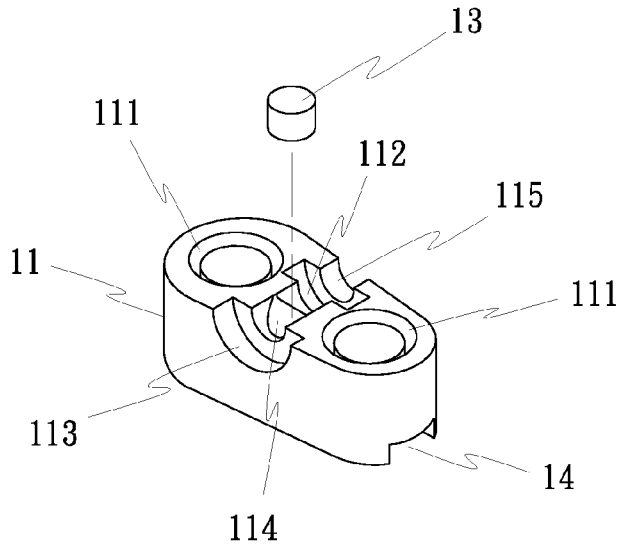
FIG. 4 is an exploded view of a socket hole blocking device for hammer in accordance with a second embodiment of the present invention.

FIG. 4 shows a socket hole blocking device for hammer in accordance with a second embodiment of the present invention. As illustrated, the cap 11 has two nail grooves 112 and 113 located on the top side between the wedge holes 111, a locating groove 114 disposed between the nail grooves 112 and 113, and a magnet 13 embedded in the locating groove 114 (see FIG. 5) for securing an iron nail 4 or 4' by means of magnetic attraction (see FIGS. 6~8).

The metal hammerhead 2 has two notches 24 and 25 located on the top wall at two sides of the socket hole 21 corresponding to the nail grooves 112 and 113, respectively, for the shank of an iron nail 4 to pass so that the head of the iron nail 4 is attracted by the magnet 13.

Figure 5:
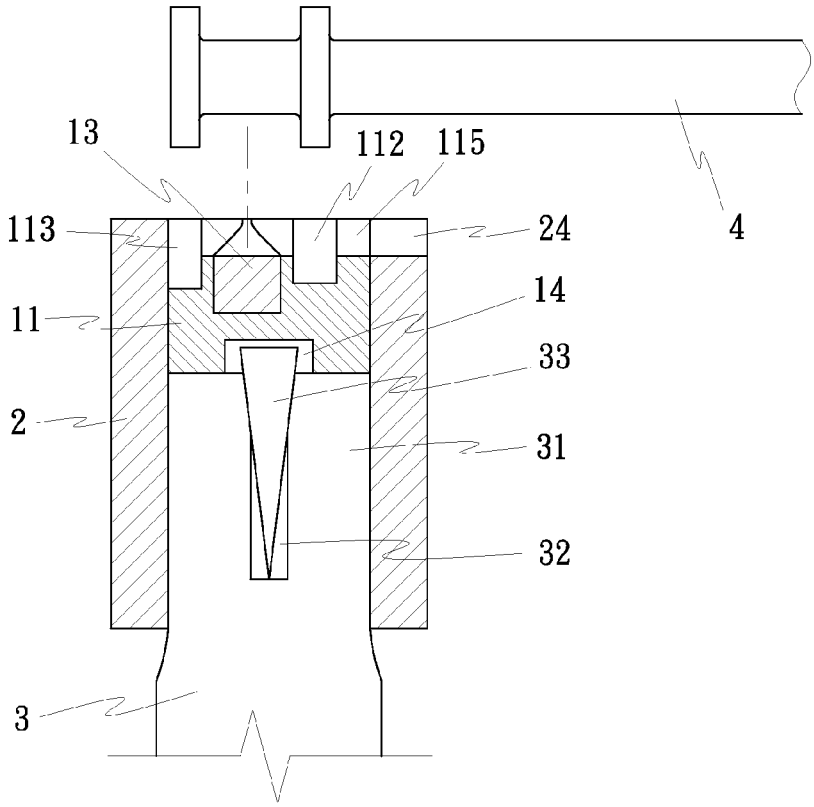
FIG. 5 is a schematic sectional view, showing the mounting of the socket hole blocking device in accordance with the second embodiment of the present invention.
Figure 6:
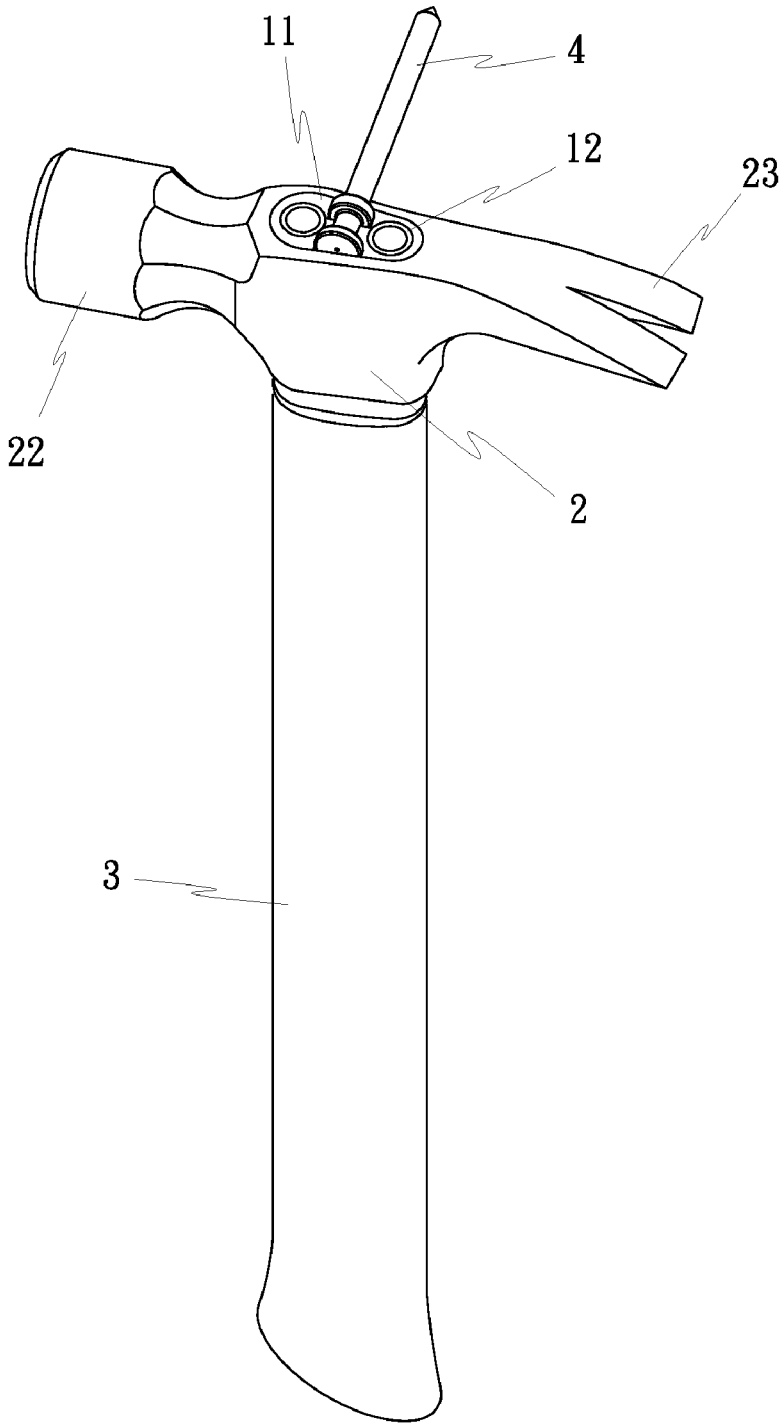
FIG. 6 is a schematic drawing showing a double-head iron nail secured to the hammerhead of the hammer constructed in accordance with the second embodiment of the present invention.

As shown in FIG. 4, the cap 11 has a notch 115 disposed at an outer side relative to the nail groove 112 to facilitate the positioning of a double-head iron nail 4 (see FIGS. 5 and 6). Another notch may be formed on the cap 11 at an outer side relative to the other nail groove 113.

Figure 7:
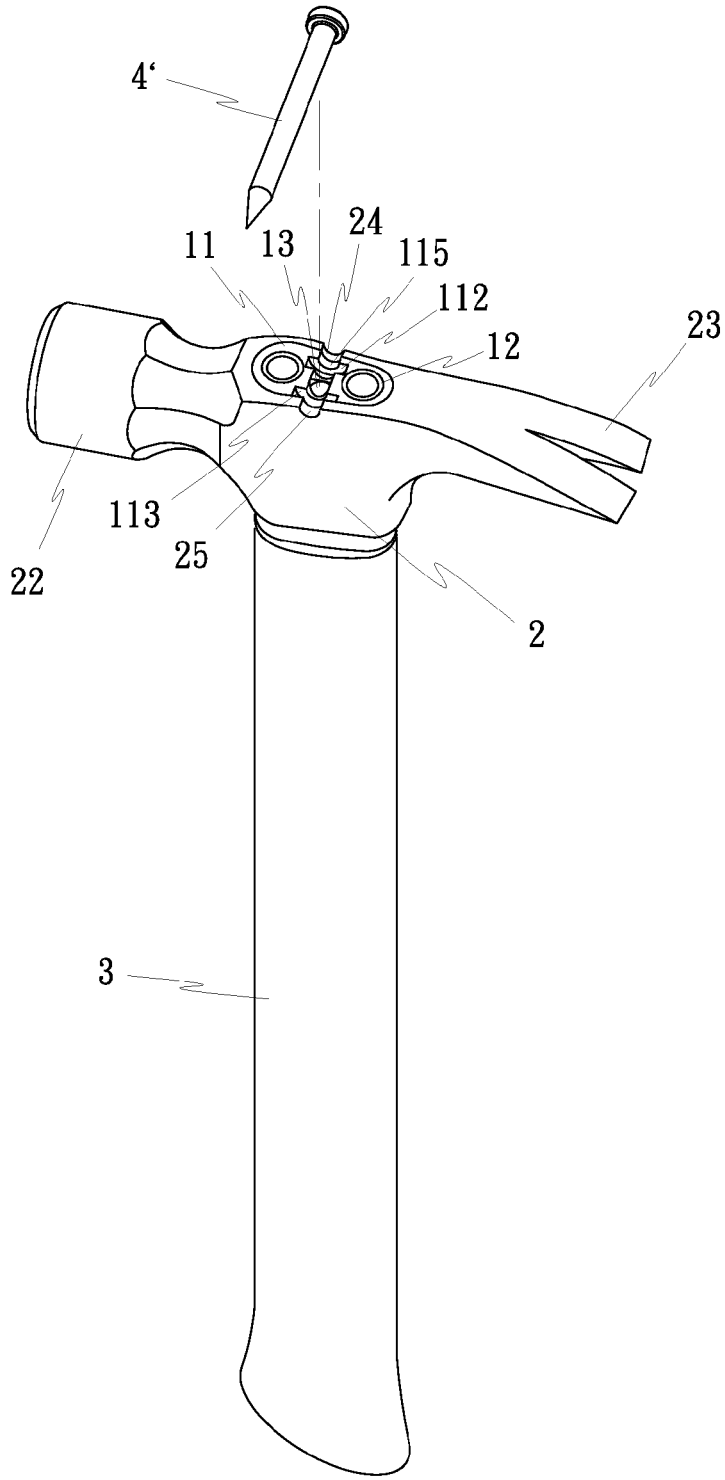
FIG. 7 illustrates a status of use of the hammer in accordance with the second embodiment of the present invention for a single-head iron nail.
Figure 8:
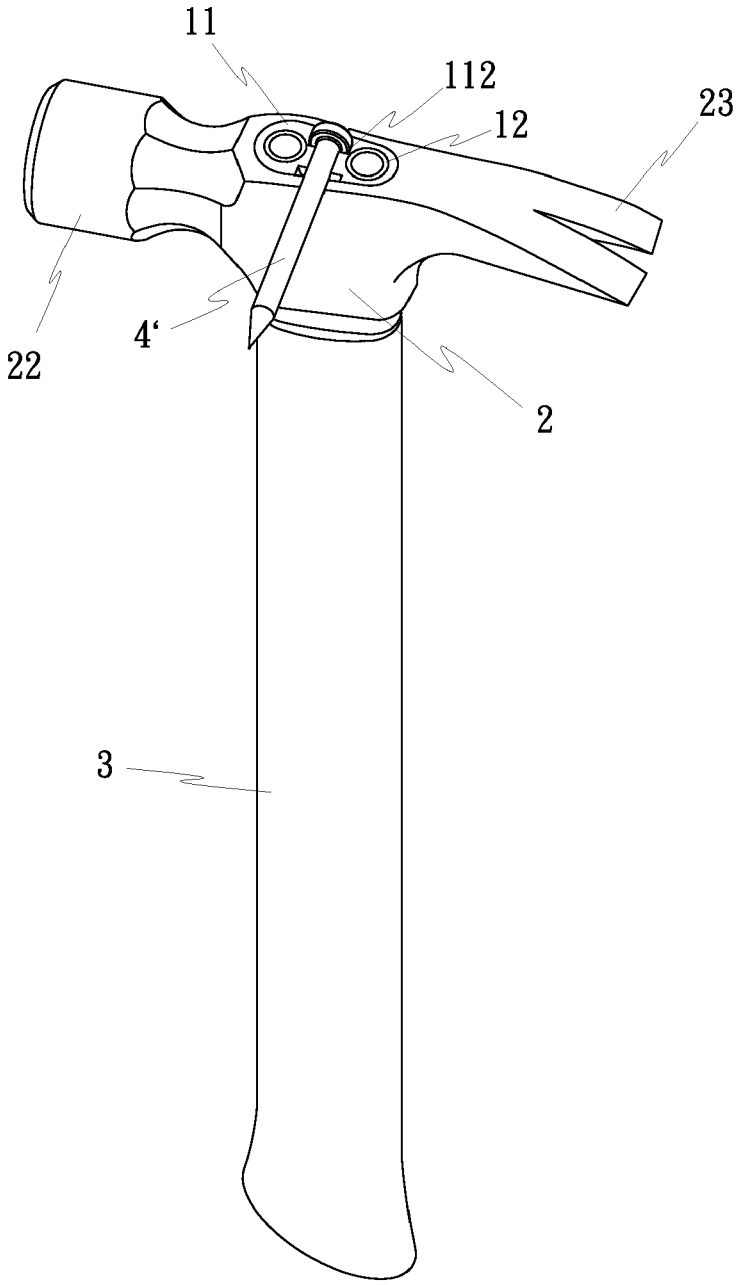
FIG. 8 corresponds to FIG. 7, showing the single-head iron nail secured to the hammerhead.

Referring to FIGS. 7 and 8, a single-head iron nail 4' can be set either in the nail groove 112 or in the nail groove 113 and attracted by the magnet 13, allowing the shank of the single-head iron nail 4' to pass through the adjacent notch 24 or 25. Thus, the hammer fits a left-handed user as well as a right-handed user.

Figure 3:
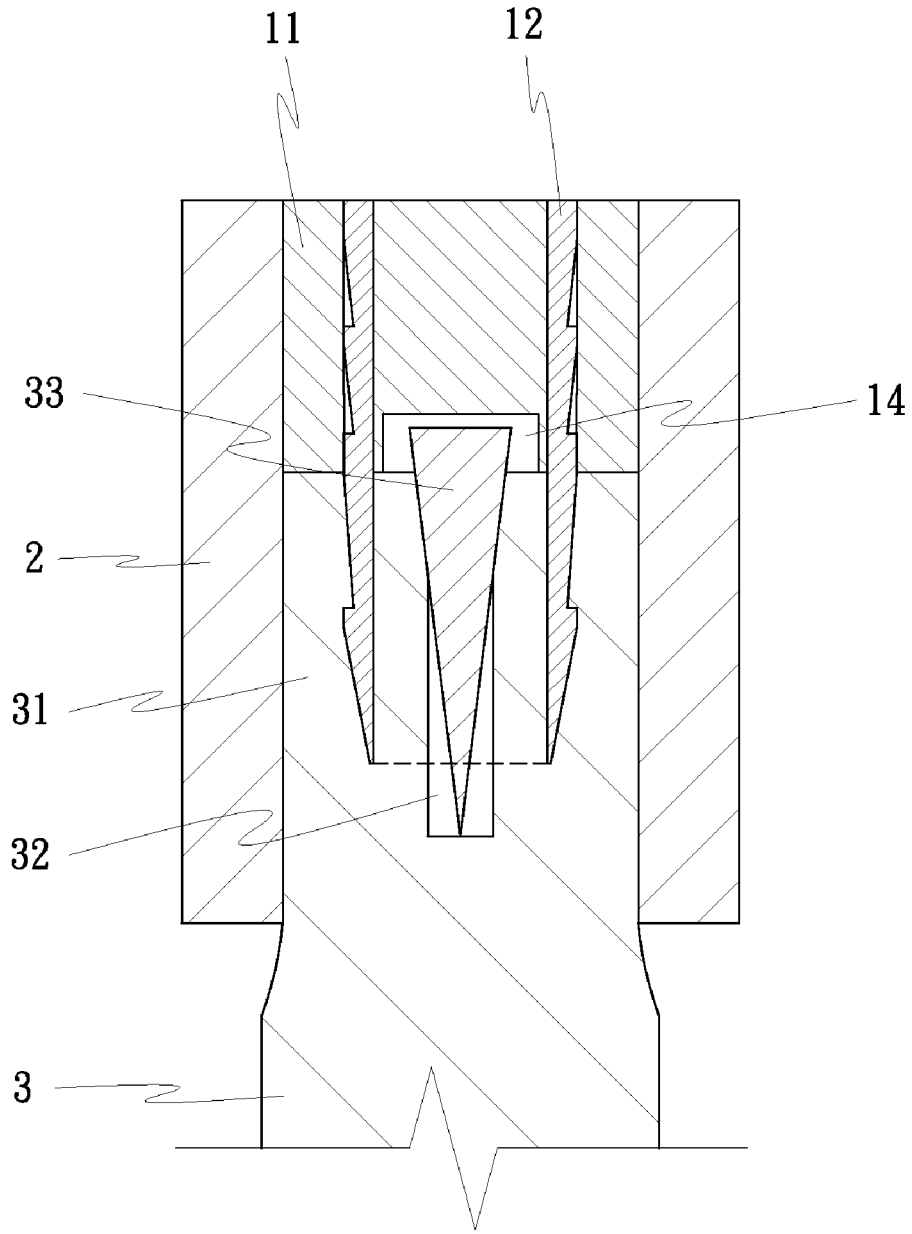
FIG. 3 is a schematic sectional view of a part of the hammer in accordance with the first embodiment of the present invention.

Referring to FIGS. 3 and 5, the cap 11 has an escape groove 14 on the bottom side. When the cap 11 is fitted into the socket hole 21 of the metal hammerhead 2, the escape groove 14 provides a space for receiving the wooden wedge 33, avoiding interference of the wooden wedge 33 with the cap 11.

The cap 11 of the socket hole blocking device 1 can be molded from plastics for the ease of fabrication and low manufacturing cost. After installation, the cap 11 is kept in flush with the metal hammerhead 2, and no further secondary processing step is necessary.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A hammer comprising a metal hammerhead having a socket hole, a wooden handle fastened to said socket hole, and a socket hole blocking device blocking said socket hole, wherein said socket hole blocking device comprises a cap fitted into said socket hole in flush with said metal hammerhead, said cap having at least one wedge hole, at least one metal wedge bolt respectively fitted into said at least one wedge hole and driven into said wooden handle, at least one nail groove, a locating groove disposed adjacent to one said nail groove, a magnet embedded in said locating groove, and a side wall in close contact with an inner circumference of the socket hole.

2. The hammer as claimed in claim 1, wherein each said metal wedge bolt has a length greater than the height of said cap.

3. The hammer as claimed in claim 1, wherein each said wedge hole is a round hole; and each said wedge bolt is a hollow cylindrical member having serrated portions extending around the periphery thereof at different elevations.

4. The hammer as claimed in claim 1, wherein said wooden handle has a top mounting endpiece fastened to said socket hole of said metal hammerhead, said top mounting endpiece having a crevice and a wooden wedge, which is forced into said crevice after said top mounting endpiece is inserted into said socket hole, said top mounting endpiece having a length shorter than the depth of said socket hole.

5. The hammer as claimed in claim 1, wherein said metal hammerhead has at least one notch corresponding to the at least one nail groove of said cap.

6. The hammer as claimed in claim 5, wherein said cap has a notch disposed at an outer side relative to one said nail groove.

7. The hammer as claimed in claim 1, wherein said cap has an escape hole on a bottom side thereof.

8. The hammer as claimed in claim 1, wherein said cap is molded from plastics.

* * * * *